US006397769B1

(12) United States Patent
Bullmer

(10) Patent No.: US 6,397,769 B1
(45) Date of Patent: Jun. 4, 2002

(54) TWIN-HULLED VESSEL WITH VARIABLE WIDTHS

(76) Inventor: Ernst Bullmer, Sophie-Stehle-Strasse 6, D-80639 Munich (DE)

( * ) Notice: Subject to any disclaimer, the term of this patent is extended or adjusted under 35 U.S.C. 154(b) by 0 days.

(21) Appl. No.: 09/509,950

(22) PCT Filed: Oct. 1, 1998

(86) PCT No.: PCT/EP98/06256

§ 371 (c)(1),
(2), (4) Date: Jun. 16, 2000

(87) PCT Pub. No.: WO99/17981

PCT Pub. Date: Apr. 15, 1999

(30) Foreign Application Priority Data

Oct. 7, 1997 (DE) ..... 197 44 291

(51) Int. Cl.[7] ..... B63B 1/00
(52) U.S. Cl. ..... 114/61.1; 114/61.18
(58) Field of Search ..... 114/61.16, 61.17, 114/61.15, 61.18, 61.1

(56) References Cited

U.S. PATENT DOCUMENTS 3,002,484 A * 10/1961 Dube ..... 114/61.16
3,139,058 A * 6/1964 Robinson ..... 114/61.17
5,052,324 A * 10/1991 Lesly ..... 114/61.15

FOREIGN PATENT DOCUMENTS

| | | |
|---|---|---|
| DE | 2903815 | 8/1980 |
| DE | 3142382 | 9/1982 |
| DE | 3228579 | 2/1984 |
| DE | 6511621.1 | 8/1985 |
| DE | 8708717.0 | 12/1987 |
| DE | 3628944 | 3/1988 |

* cited by examiner

*Primary Examiner*—Stephen Avila
(74) *Attorney, Agent, or Firm*—Burns Doane Swecker & Mathis, L.L.P.

(57) ABSTRACT

A multi-hulled vessel of variable width is disclosed, in which two floats (1, 2) are connected with one another by means of a variable connection device (4). By means of the connection device, the distance between the floats can be varied. At the maximum distance between them, the vessel features optimum seaworthiness, while at the minimum distance between them it has a small berthing space requirement. The connection device (4) supports the central unit (3), which encompasses a useful area unit (5). The floats (1, 2) do not have a continuous deck height over their entire length, but feature recesses (120, 220). These recesses (120, 220) are pushed beneath the useful area unit (5) when the floats are adjusted to their minimum interval spacing.

29 Claims, 6 Drawing Sheets

Figure 1:
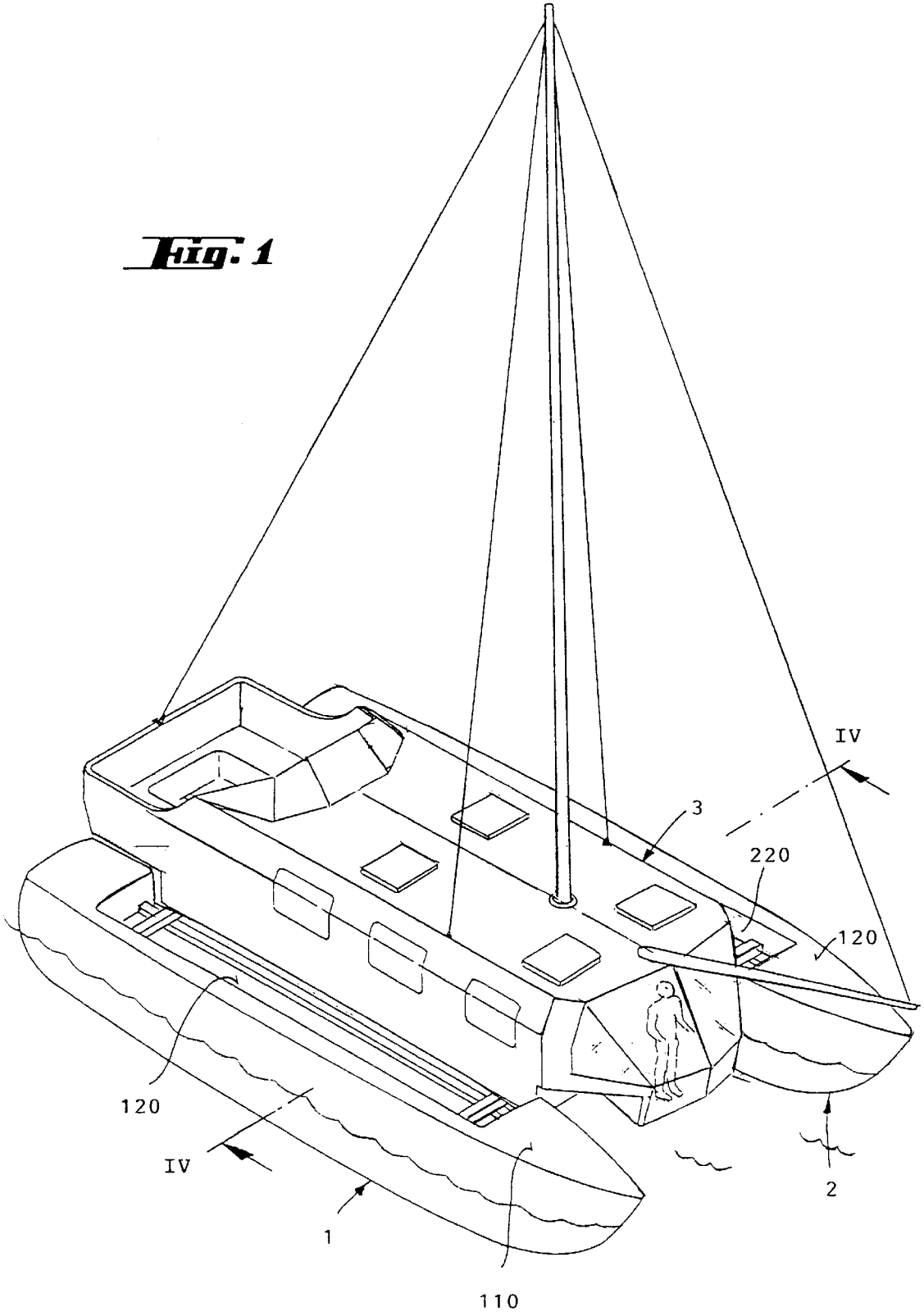

IV
3
220
120
120
IV
1
110
2

TWIN-HULLED VESSEL WITH VARIABLE WIDTHS

DESCRIPTION

The present invention relates to a vessel, and more precisely to a multi-hulled vessel with sails, such as catamarans.

The particularly good seaworthiness of multi-hulled vessels has by now been demonstrated, but there are still a number of obstacles which inhibit the widespread use of multi-hulled vessels, and of catamarans in particular, an the sector of long-distance sailing.

Because of its width, a catamaran requires a considerable amount of space, which becomes apparent when seeking a berth in a marina with higher berthing charges. In addition to this, in a number of harbours no place is provided for catamarans, or catamarans are required to berth in remote areas of the harbour.

The financial disadvantages and inconveniences referred to deter many potentially interested people from purchasing a catamaran, although they are convinced of the seaworthiness of the vessel.

In addition to this, catamarans feature a shallower draught than comparable single-hulled vessels. This accordingly makes them ideally suited for inland waterway operations. In this situation, however, the width of the catamaran proves to be an obstacle when moving along smaller waterways.

From German Patent DE 3228579 C2 a catamaran of variable width is known, in which the bridge can be pushed inboard into the hulls in order to reduce the width. The construction principle disclosed in DE 3228579 C2 allows for simplified road transport of the catamaran. However, this catamaran can only be inhabited without restrictions in the extended state, since when the bridge is pushed inboard into the inhabitable hulls, the headroom in the hulls is lost.

From the state of the art, a catamaran of variable width is also known, in which the accommodation gondola is supported by two floats, which can be pivoted inwards by means of aluminium bars in the horizontal plane forwards to the midships line beneath the accommodation gondola. This renders the inhabitability independent of the adjusted width of the catamaran.

The catamaran described lacks the required buoyancy reserves in the stern area to render it seaworthy, since the flat lines in the stern area of the floats can lead to considerable problems, especially when running before the sea with a following swell.

The flat lines are incurred by the design, since only in this way can the floats be pivoted inwards beneath the accommodation gondola.

It is accordingly the object of the present invention to overcome the disadvantages indicated, by providing for a vessel which features a low spatial requirement without restrictions to accommodation comfort in port, and nevertheless features a high standard of seaworthiness. This object is resolved according to the invention by the vessel of variable width according to independent claim 1. Further considerations and advantages of the present invention are derived from the independent claims, the abstract, and the drawings.

The claims are to be understood as an initial and non-restrictive attempt at formulation, to define the present invention in general terms. According to the invention, a vessel, in particular a catamaran, of variable width is provided for, which at maximum width features the usual seaworthiness of a multi-hulled vessel, and at minimum width has a substantially reduced spatial requirement.

The floats of the vessel are designed as rigid floats, the lateral distance of which to the mid-line axis of the vessel can be variably adjusted.

The floats support a central unit, which encompasses a useful area unit, for preference an accommodation gondola.

The floats do not feature any continuous flat deck surface, but provision is made over the entire length of the useful area unit for a recess, so that the floats in the area of the recess can be pushed beneath the useful area unit when the width of the vessel is reduced.

The recesses according to the invention in the decks of the floats extend in the longitudinal direction of the floats, but they end at a distance from the bow and stern ends of the floats. In the bow and stern areas, the decks of the floats are accordingly of their full height, in order to guarantee adequate buoyancy reserves. For preference, the decks of the floats feature a full height over at least 35% of the overall length.

The recesses go from the side of the float which is turned towards mid-line axis of the vessel, but the height of the side on the outside of the floats is designed to be continuously at the height of the deck surface.

For preference, the floats are designed as non-inhabitable floats. This allows for the recess in the deck surface to be implemented without consideration of accommodation comfort, such as, for example, the spatial height.

The central useful area unit is designed for preference as an accommodation gondola, which for preference further offers an adult person the normal headroom; i.e. it features on the inside a spatial height from 2.0 m to 2.4 m.

Because of the recesses in the floats, the residential gondola can, however, be arranged so deep that it offers only a small area of resistance to the wind.

The underside of the accommodation gondola is arranged adequately high above the surface of the water so as to exclude any impairment due to the height of the sea under normal circumstances.

It is a further aspect of the present invention, despite the movement of the floats in relation to one another and in relation to the central useful area unit, to guarantee a sufficiently rigid connection for the seaworthiness of the vessel to be guaranteed.

To this end, a connection device is provided, which is anchored both to the central useful area unit as well as to the floats. This connection device provides the mechanical functions to change the distance between the floats.

Figure 2A:
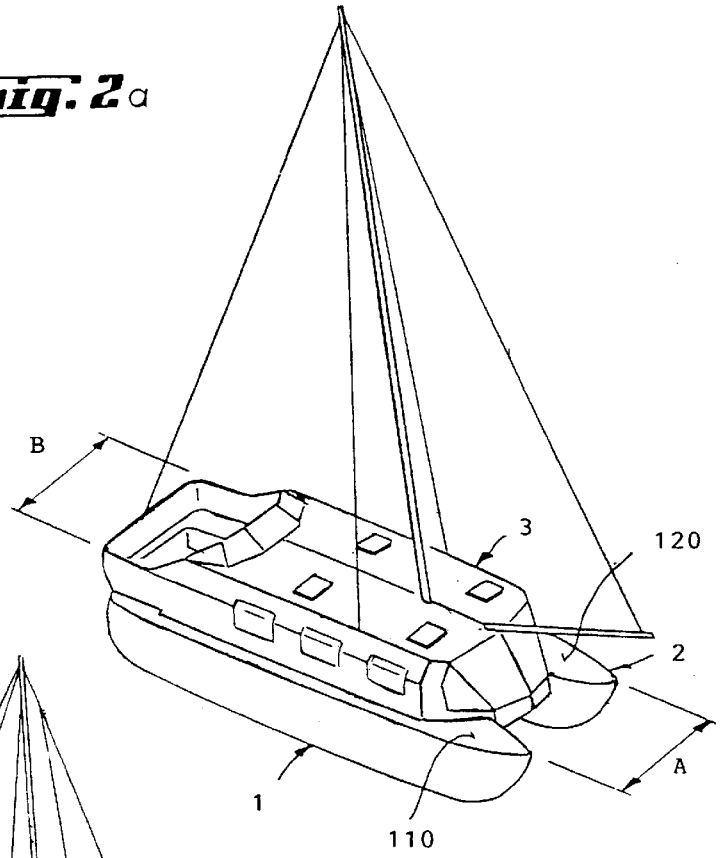
Figure 3:
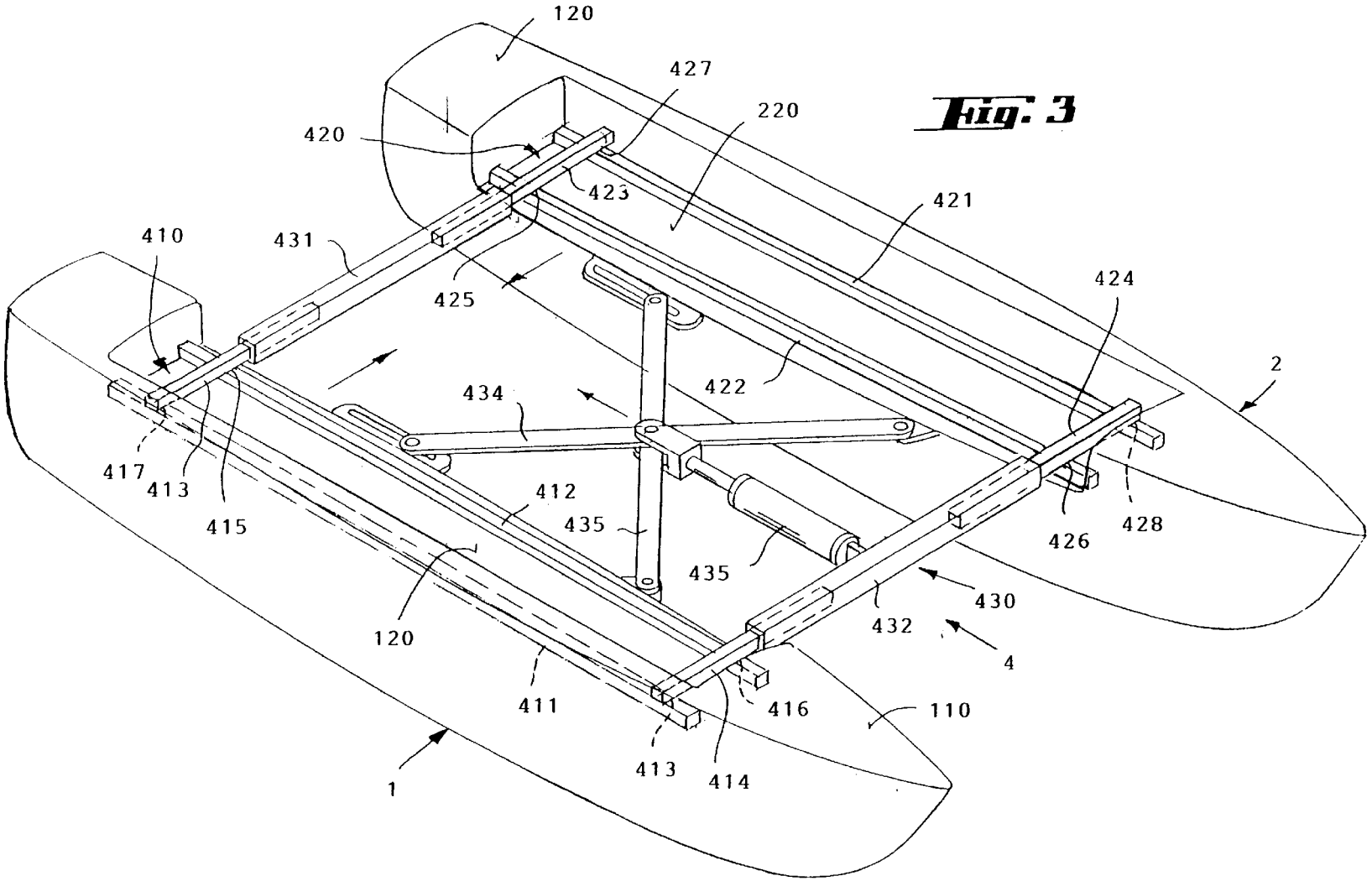
Figure 4:
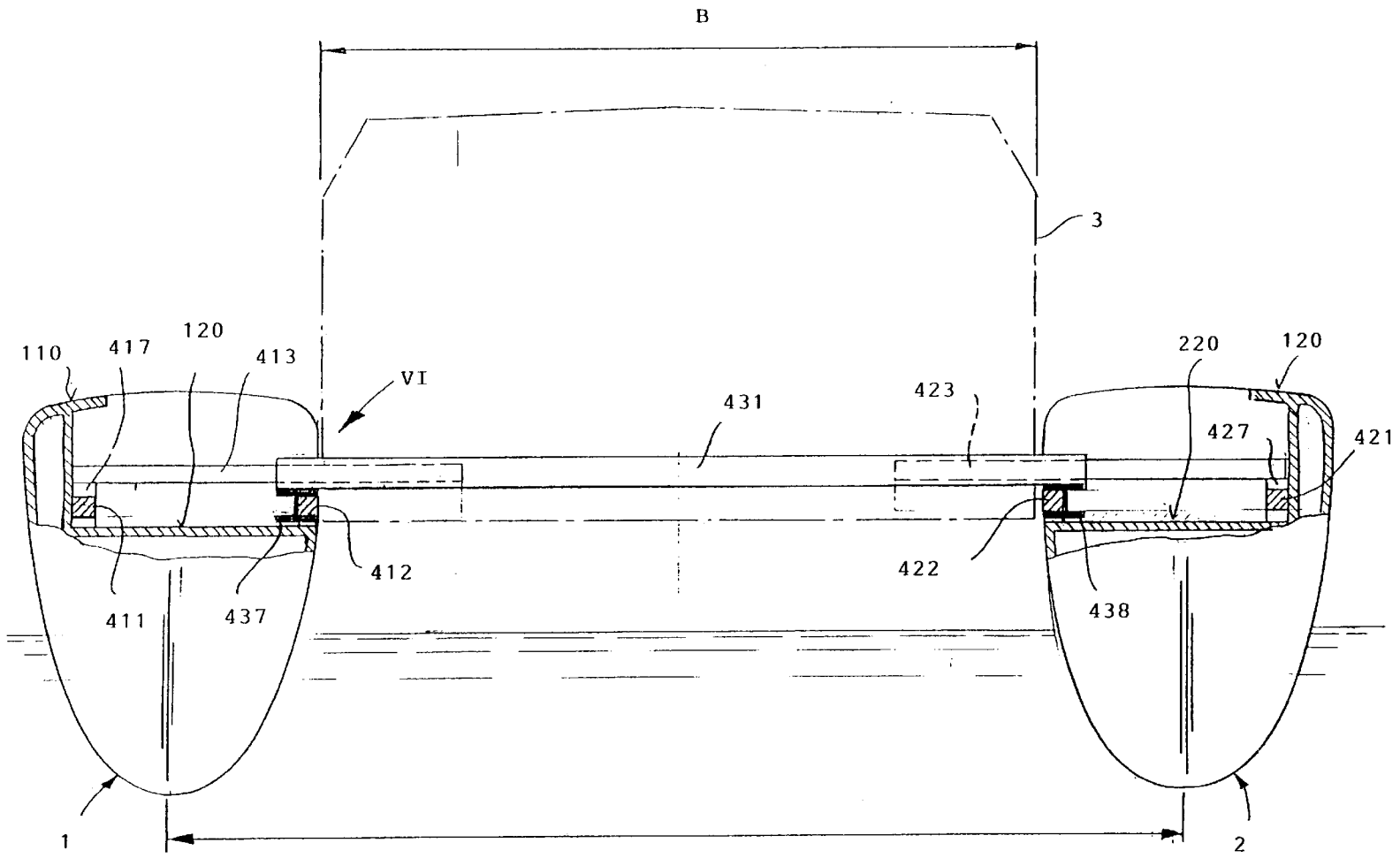
Figure 5:
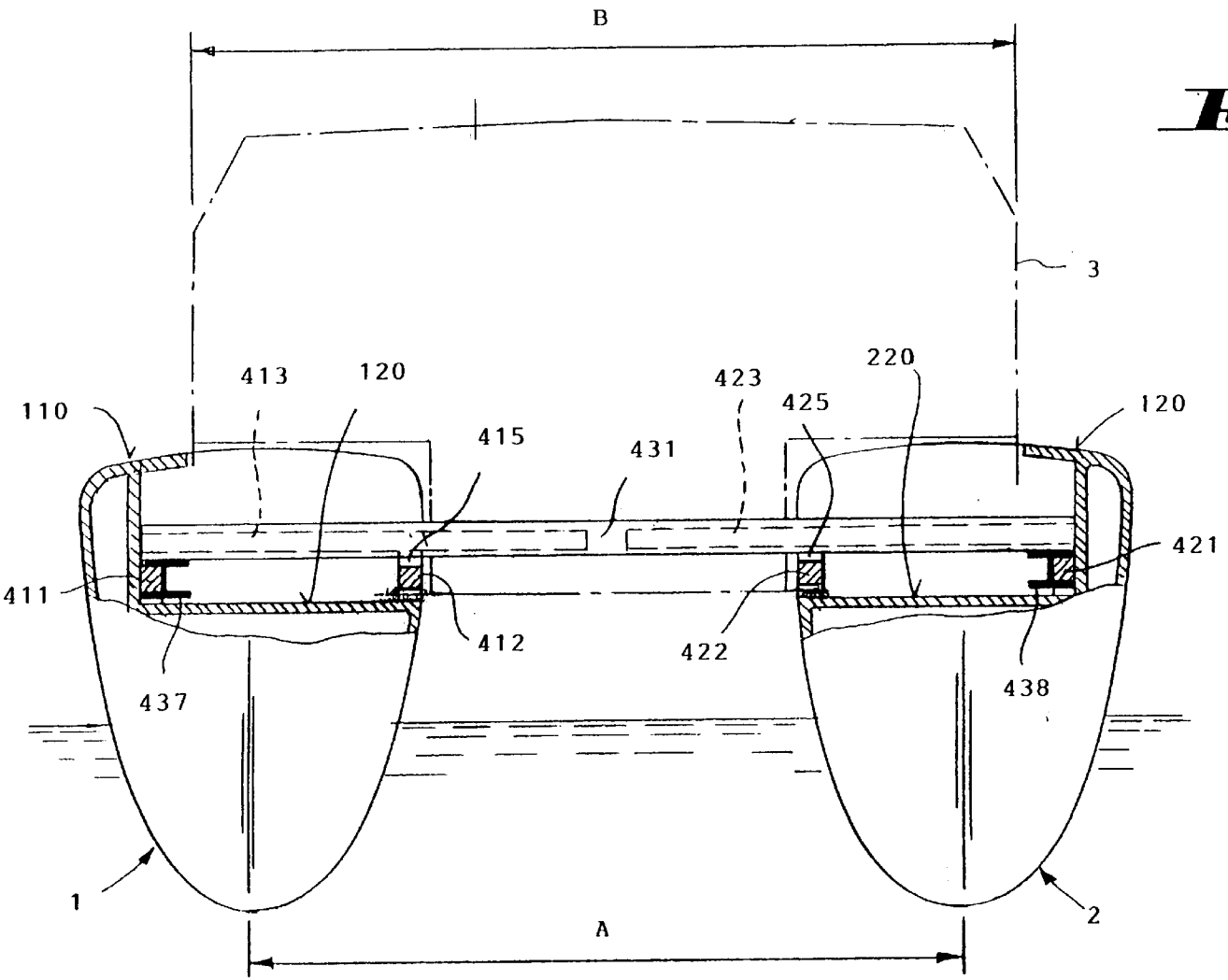
Figure 6:
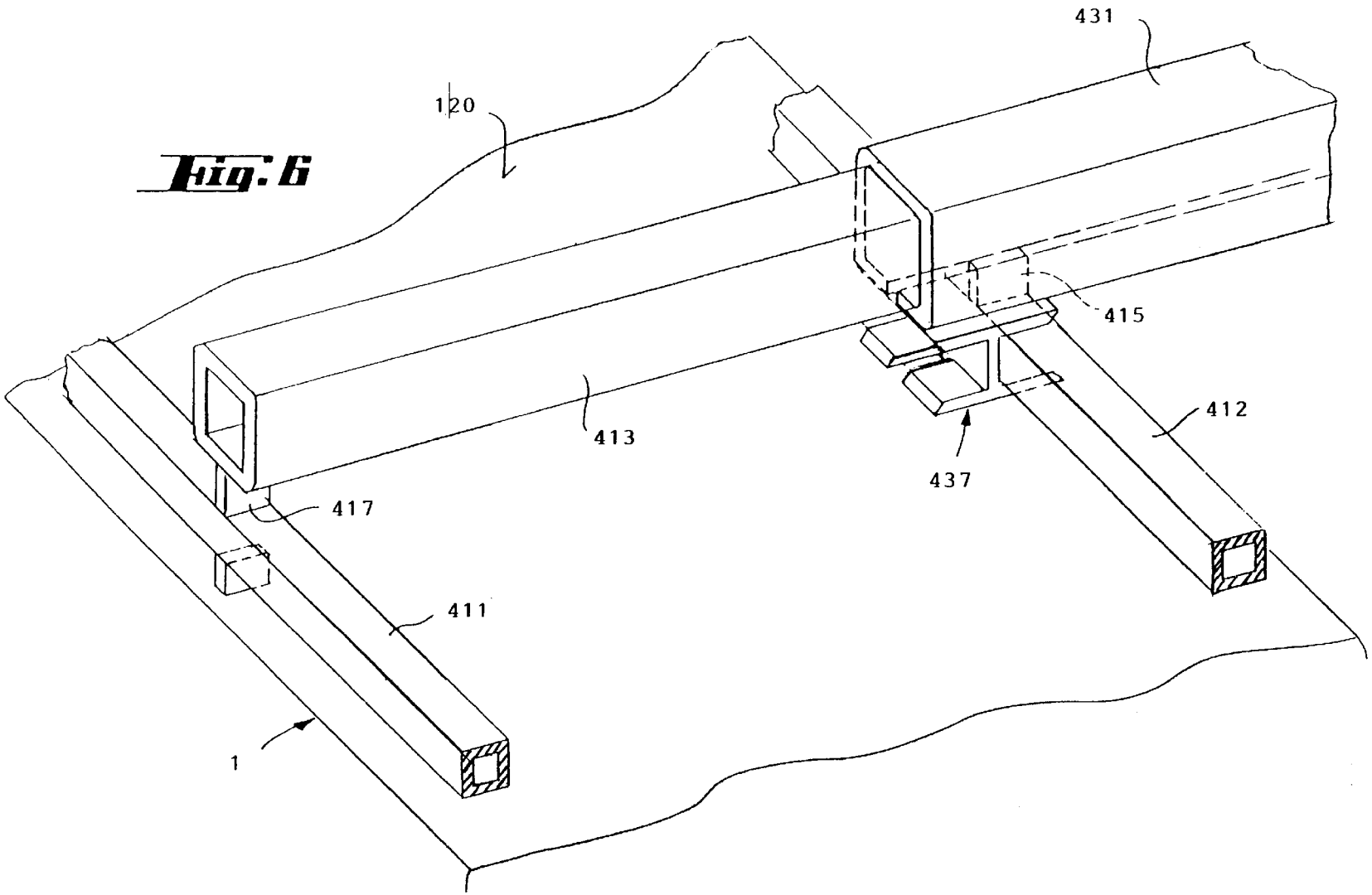

The invention is now described in detail on the basis of the appended drawings. These show:

FIG. 1 An overall perspective view of the vessel according to the invention, with the floats moved outwards;

FIGS. 2*a* and *b* Schematic perspective representations of the vessel with the floats moved in (a) and outwards (b);

FIG. 3 A schematic sketch of the floats in reciprocal effect with the connection element;

FIG. 4 A section along the line IV—IV in FIG. 1, with the floats moved outwards;

FIG. 5 A section as in FIG. 4, with the floats moved inwards;

FIG. 6 A detailed representation of the area VI in FIG. 4.

The invention is described hereinafter by way of the example of a catamaran.

Figure 2B:
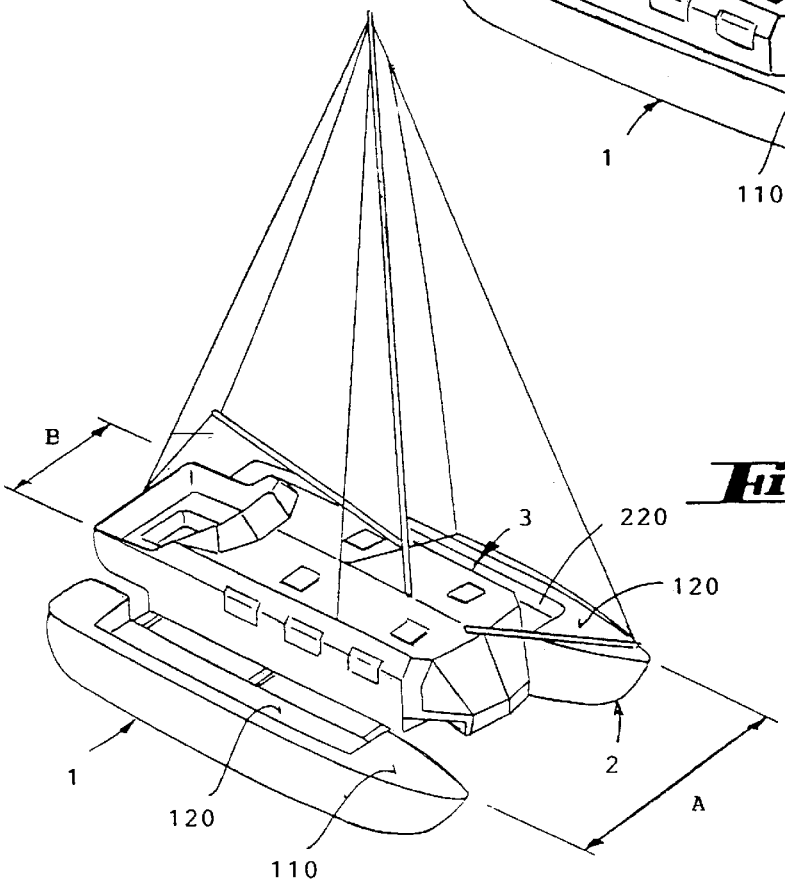

Reference is made first to FIGS. 1 and 2. In FIG. 1 the two floats 1 and 2 of the catamaran are shown, which support the central unit 3. The floats 1, 2 can be adjusted with the connection unit to a variable distance between one another, with the result that the width of the vessel can be varied to a substantial degree. FIG. 2*b* shows a catamaran in the maximum width state, in which the floats have their maximum distance between one another. In this state, the catamaran features the usual seaworthiness.

When the distance between the floats 1, 2 is reduced by means of the variable connection device, the width of the vessel is also reduced. FIG. 2*a* shows the vessel in the state of minimum width. In this state, the catamaran has a substantially reduced space requirement, with the result that a normal berth in a marina is adequate. In the arrangement shown in the sketch, the floats extend laterally above the useful area unit. It is however possible for the floats to be designed in such a way that in the minimum width state they do not project laterally over the useful area unit.

The function principle of the catamaran is described hereinafter on the basis of FIGS. 3 to 6. FIG. 3 corresponds approximately to FIG. 1, in which context the central unit has been left out; as a result, the connection device 4 becomes visible. The connection device 4 connects the two floats 1, 2 with the central unit 3, in which situation the connection device 4 is designed to be sufficiently strong to support the central unit. To achieve this, the central unit is anchored by secure mechanical means both to the float 1 as well as to the float 2. For preference, the connection device 4 is arranged in the area of the recesses 120, 220 in the deck 110, 210 of the floats 1, 2. As is shown more precisely in FIG. 4, the connection device 4 encompasses a central section 430 and side sections 410, 420. The central section features at least one, and for preference two or more, transverse spars 431, 432, which extend essentially perpendicular to the longitudinal direction of the vessel. The side sections 410, 420 of the connection device 4 encompass side spars 413, 414, 423, 424, which are connected in pairs to the transverse spars. The side spars are essentially oriented in the direction of the transverse spars 431, 432, and are capable of displacement in their longitudinal direction. This means that the side spars 413, 414, 423, 424 serve as variable length extensions of the transverse spars 431, 432. The side spars 413, 414, 423, 424 are anchored in the floats 1, 2, so that the distance between the two floats 1, 2 can be varied by displacing the side spars in relation to the transverse spars.

In an especially preferred embodiment, the transverse spars 431, 432 are designed as hollow profile elements. This hollow profile design may feature any desired polygonal or circular cross-section, in which situation a triangular or square cross-section is preferred.

For preference, the hollow profiles should be designed by means of statics calculations in such a way that they will even resist the forces which occur during the heaviest seas. As represented in FIGS. 4 and 5, the side spars 413, 414, 423, 424 are pushed inwards as inside runners into the hollow profile of the transverse spar. The inside runners are provided on their outer surfaces with rollers mounted on ball-bearings at suitable distances from one another, in order to facilitate the displacement of the inside runners in the transverse spar.

According to FIG. 6, the transverse spars 431, 432 feature slit-like apertures on their underside, through which securing elements 415, 416, 425, 426; 417, 418, 427, 428 project, to secure the side spars to the floats.

The securing elements 415, 416, 425, 426, 417, 418, 427, 428 can be anchored to the floats 1, 2 directly in the area of the recesses 120, 220.

To increase the stability of the vessel, it is preferential for the side spars on one side of the vessel to be connected in each to one another by means of at least one, and for preference two or more, longitudinal spars running parallel to the axis of the vessel. Thus, for example, the side spars 413, 414 arranged on the right side of the vessel are connected by means of the securing elements 415, 416, 417, 418 to the longitudinal spars 411, 412, while the side spars 423, 424 arranged on the left side of the vessel are connected by means of the securing elements 425, 426, 427, 428 to the longitudinal spars 421, 422. The longitudinal spars 411, 412, 421, 422 are then in each case anchored in the floats 1, 2 in the area of the recesses 120, 220.

In order to increase the mechanical strength of the vessel still further, additional bearing elements 437, 438 are provided for, which may be located either in the central unit or on the connection device. In a preferred embodiment, the bearing elements 437, 438 are designed as a double T-profile. In an especially preferred embodiment, in each case a T-profile 437 connects the end sections of the transverse spars 431, 432 on one side of the vessel. Alternatively, the double T-profiles may also be secured to the under edge of the useful area unit. The double T-profiles 437, 438 run parallel to the longitudinal spars 411, 412, 421, 422, and are designed in such a way that they can in each case accommodate a longitudinal spar in a precise fit on one side.

By way of example, FIG. 6 shows the mounting of the longitudinal spar 412 in the bearing element 437. This configuration is adopted when the side spar 413 is entirely extended. In this situation, the floats 1, 2 have their maximum distance between one another, with the result that the vessel features optimum seaworthiness. Thanks to the mounting of the longitudinal spars 412, 422 in the bearing elements 437, 438, the floats 1, 2 are additionally fixed to the central unit 3 and to the central section 430 of the connection device 4 respectively, which increases the mechanical strength, and in particular the torsional rigidity, of the vessel in the maximum width state.

If, on the other hand, the floats are set at a minimum distance to each other, then the outer longitudinal spars 411, 421 are mounted in the bearing elements 437, 438. In this way, the configuration of minimum width is also stabilized, which is usually adopted in harbour.

In another embodiment, another combination of coupling elements and the bearing elements complementary to them are used, in order to achieve additional mechanical coupling.

For example, a spar with a sawtooth profile facing inwards and a sawtooth profile facing outwards can be arranged in each case on each float. The bearing elements on the under side of the useful area unit are then designed to be complementary to these coupling elements.

In a particularly preferred embodiment, the coupling elements and bearing elements are designed of structurally identical sawtooth profiles, which are arranged in such a way that they can engage with one another.

Apart from a sawtooth profile, other forms are also conceivable. For example, the coupling elements can be designed as a series of tapering projections, such as pyramids, pyramid stumps, prisms, prism stumps, cones, cone stumps, etc. The coupling elements designed with the projections guarantee a better coupling with the bearing elements than can be achieved between the double T-profile and a longitudinal spar.

In a particularly preferred embodiment, some or all of the bearings or connection elements are mounted between the floats 1, 2 of the connection device 4 and the central unit 3 in damping elements. These damping or shock-absorbing elements can, for example, be manufactured from wear-resistant rubber or a synthetic elastomer.

To adjust the distance between the floats, a variety of automatic and hand-operated mechanisms can be considered. FIG. 4 shows, for example, a hydraulic cylinder 435, which drives the scissor arms 433, 434, by means of which the distance between the side sections 410 and 420 is adjusted.

In another embodiment, hydraulic drives are integrated in the transverse spars 431, 432, and take effect directly on the side spars 413, 414, 423, 424. Instead of the hydraulic cylinders, worm gears may also be used, which can be optionally driven by an electric motor or by hand.

In a particularly preferred embodiment, covers are provided which cover the recesses 120, 220 in the decks 110, 210 of the floats 1, 2, when the vessel is in the seagoing state; i.e. the floats are set to maximum interval spacing. In this way, a continuous deck surface is guaranteed on the floats 1, 2, as a result of which the floats can more easily be walked on.

Thanks to the modular construction of the vessel, it is a simple matter for the vessel to be dismantled for transport. In this way, the vessel can be delivered by road transport in its individual modules prior to final assembly. For reference, it should be possible for the owner to dismantle the vessel into its modules, in order, for example, to carry out road transport for changing berth areas without any major complications.

The central unit features for preference a length of between 5 m and 15 m, and a width of between 2.5 m and 5 m. In a particularly preferred embodiment, the central unit has a width of 4.7 m and a length of 10 m. The floats of a catamaran according to the invention have for preference a length of between 7 m and 17 m. In an especially preferred embodiment, the length of the floats is 13 m. The width of the float amounts for preference to between 0.8 m and 2 m. In a particularly preferred embodiment, the width of the floats is 1.6 m.

The deck height of the floats is for preference between 1 and 2 m above the water line. In a particularly preferred embodiment, the deck height lies at 1.5 m above the water line. The recesses are for preference between 0.5 m and 1.5 m above the water line. In a particularly preferred embodiment, the recesses are 1 m above the water line.

In a particularly preferred embodiment, the useful space unit features an aperture through which the front deck surface of the floats can be accessed for walking on, when they are set to the minimum distance between them. For preference, this aperture is designed to be closable.

In a further preferred embodiment, the connection device is designed as a single piece with the central unit or the useful area unit respectively.

The present invention has been described in detail on the basis of the example of a catamaran. Departures from this and modifications are likewise conceivable, without deviating from the basic concepts of this invention.

The scope of protection is therefore not limited to the examples described, but is defined exclusively by the claims.

What is claimed is:

1. A catamaran capable of seagoing sailing, comprising:

two non-inhabitable floats arranged essentially parallel to a longitudinal axis of the catamaran, at a side distance from a center axis of the catamaran, wherein the non-inhabitable floats can be variably adjusted by a horizontal displacement essentially perpendicular to the center axis of the catamaran; and a central unit, which encompasses an accommodation gondola, in which the central unit is supported by the floats, wherein the floats further include a deck, having a recess, the recess extending over the length of the accommodation gondola, wherein the floats are capable of being positioned beneath the accommodation gondola, whereby the recesses extend from the side of the float which is turned towards the center axis of the vessel, and end before the outer walls of the floats, whereby the recesses extend in the longitudinal direction of the floats, while they end at a distance from the bow and stern ends of the float.

2. A catamaran according to claim 1, further including, a connection device for connecting the floats with the central unit, in which situation the lateral distance between the floats can be variably adjusted by means of the connection device.

3. A catamaran according to claim 2, wherein the central unit includes a width and a distance between keel lines of the floats wherein the distance between the keel lines is smaller than the width when the floats are adjusted to the minimum distance between them, and the distance between the keel lines of the floats is greater when the floats are adjusted to a maximum interval space.

4. A catamaran according to claim 1, wherein the catamaran further includes cover devices for covering the recesses.

5. A catamaran according to claim 4, characterized in that the floats when disposed having maximum interval spacing include a deck surface which can be walked on continuously when the cover devices are covering the recesses.

6. A catamaran according to claim 2, characterized in that the connection device comprises a central section secured to the central unit, and two side sections, wherein the side sections are secured to the floats, whereby the side sections are movable in relation to the central section.

7. A catamaran according to claim 6, characterized in that the central section of the connection device includes at least two transverse spars, which extend essentially perpendicular to the longitudinal direction of the vessel; wherein the side sections of the connection device further include side spars, which are displaceably connected in the longitudional direction of the transverse spars with the transverse spars.

8. A catamaran according to claim 7, wherein the side spars are further connected in pairs to a transverse spar, wherein one side spar is secured to one of the two floats, and the other is secured to the other of the two floats.

9. A catamaran according to claim 7, wherein at least one of the transverse spars is designed having a hollow profile, and the side spars further include an inside runner, which is adapted to be received by an inner bore of the transverse spar.

10. A catamaran according to claim 9, wherein the hollow profile of the transverse spar comprises two end sections wherein the transverse spar further includes at least one slit-shaped aperture on its under side, disposed in a longitudinal direction of the transverse spar, and located on the inside runners of the side spars and at least one securing element which projects from the transverse spar through the corresponding slit-shaped aperture.

11. A catamaran according to claim 10, wherein each side spar further includes in its outer end section at least one outer securing element.

12. A catamaran according to claim 10, wherein the securing element serves to secure the side spars to the floats.

13. A catamaran according to claim 6 characterized in that the side sections of the connection device further include at least two longitudinal spars wherein the longitudinal spars are anchored to one of the two floats in its longitudinal direction.

14. A catamaran according to claim 13, wherein the securing elements are secured to the longitudinal spars.

15. A catamaran according to claim 1, characterized in that the central unit further includes a bearing element on its lower right and left side edges, the bearing element being adapted so as to accommodate with a precise side fit, with its side turned towards the center of the vessel, an inner coupling element, when the two floats are adjusted to the maximum distance between them, whereby the inner coupling elements are in each case anchored rigidly to a float to connect end sections of the transverse spars to the floats.

16. A catamaran according to claim 15, wherein at least one of the bearing elements is further adapted to designed in such a way that it can accommodate with a precise fit an external coupling element in each case, with its side which is turned away from the center of the vessel, when the two floats are adjusted to the minimum distance between them, whereby the outer coupling elements are in each case rigidly anchored to a float.

17. A catamaran according to claim 15, wherein the longitudinal spars running the length of the inner sides of the floats serve as inner coupling elements.

18. A catamaran according to claim 16, wherein the longitudinal spars running the length of the outer side of the floats serve as outer coupling elements.

19. A catamaran according to claim 15, characterized in that at least one of the bearing elements is a double T-profile, which extends essentially along the length of the accommodation gondola.

20. A catamaran according to claim 15, further characterized in that the side of the coupling elements turned towards the bearing elements, further includes in each case several tapering projections, and the bearing elements are designed with structures which are complementary to the projections, with the result that the projections engage with the corresponding structures when the floats are adjusted to the maximum or minimum space between them.

21. A catamaran according to claim 20, wherein the coupling elements include a series of projections arranged next to one another, the projections chosen from the group consisting of: prisms, prism stumps, pyramids, pyramid stumps, cones, or cone stumps.

22. A catamaran according to claim 1, characterized in that the lateral distance between the floats can be automatically adjusted by means of a hydraulic device.

23. A catamaran according to claim 1, wherein the lateral distance between the floats can be adjusted by hand.

24. A catamaran according to claim 1, wherein the lateral distance between the floats can be adjusted by means of at least one scissor element .

25. A catamaran according to claim 1, characterized in that the mechanical connections between the various different components of the vessel further include damping or shock-absorbing elements at least in part.

26. A catamaran according to claim 1, characterized in that the accommodation gondola provides in its interior a headroom of between 1.8 m and 2.2 m.

27. A catamaran according to claim 1, characterized in that the recess in the deck of the float lies between 0.3 m and 1.0 m, for preference 0.4 m to 0.8 m, and further for preference 0.5 m to 0.7 m, lower than the remaining deck of the float.

28. A catamaran according to claim 1, characterized in that the accommodation gondola comprises an aperture on its from side, through which the front area of the deck surfaces of the floats can be walked on, when the floats are adjusted to their minimum distance.

29. A catamaran according to claim 1, characterized in that the lateral distance between the floats can be automatically adjusted by means of an electric motor.

* * * * *